United States Patent [19]

Abdo

[11] Patent Number: 4,657,132

[45] Date of Patent: Apr. 14, 1987

[54] CARTRIDGE HOLDER

[76] Inventor: Saide Abdo, 3005 Herrick Dr., Lansing, Mich. 48910

[21] Appl. No.: 682,855

[22] Filed: Dec. 18, 1984

[51] Int. Cl.[4] ..... F42B 37/00

[52] U.S. Cl. ..... 206/3; 206/485; 206/443; 224/203; 224/239; 224/240; 224/247

[58] Field of Search ..... 206/3, 443, 485; 224/203, 236, 240, 239, 914; 42/87, 88, 89; 220/247, 339, 918

[56] References Cited

U.S. PATENT DOCUMENTS

| | | | |
|---|---|---|---|
| 85,241 | 12/1868 | Paine | 206/3 |
| 85,849 | 1/1869 | Pittman | 206/3 |
| 109,365 | 11/1870 | King | 224/239 |
| 136,987 | 3/1873 | Gaines | 224/247 |
| 1,610,110 | 12/1926 | Reiter | 224/247 |
| 2,287,425 | 6/1942 | Fox | 206/505 |
| 2,756,913 | 7/1956 | Oswald | 224/239 |
| 3,051,130 | 8/1962 | Morris | 224/236 |
| 3,066,791 | 12/1962 | Bivens | 206/3 |
| 3,297,217 | 1/1967 | Nichols | 224/240 |
| 3,768,635 | 10/1973 | Eggert | 206/380 |
| 3,822,783 | 7/1974 | Mortensen | 206/223 |
| 3,837,477 | 9/1974 | Boudreau | 206/376 |
| 3,841,472 | 10/1974 | Fuller et al. | 206/485 |
| 3,923,152 | 12/1975 | Minneman | 220/339 |
| 3,990,170 | 11/1976 | Griffis | 206/3 |
| 4,047,652 | 9/1977 | Domingos | 224/236 |
| 4,073,328 | 2/1978 | Franklin | 206/315.11 |
| 4,349,106 | 9/1982 | Bogel | 206/485 |
| 4,408,707 | 10/1983 | Rogers | 224/239 |
| 4,498,612 | 2/1985 | Geekie, Jr. | 220/918 |

*Primary Examiner*—Joseph Man-Fu Moy
*Assistant Examiner*—David T. Fidei
*Attorney, Agent, or Firm*—George P. Pappas

[57] ABSTRACT

A waist mountable cartridge holder assembly comprising a cartridge case having integrally formed base, foldable hinge and cover portions. A cartridge holder track support member is provided on the base portion so as to snap clampably supportably engage a plurality of individual cartridges in transversely oriented spaced-apart longitudinally aligned fixed positions above the base portion so as to enable finger access between the base and the individual cartridges so as to facilitate direct unloading of individual cartridges therefrom. The case cover portion is selectively foldable onto the base portion so as to cover the cartridge holder track support member and cartridges supported thereon. A snap tab lock is provided to extend from the base portion to lockably engage the cover portion in its closed position. The snap lock is selectively snap releasable so as to permit flip opening of the cover member to provide easy finger access to cartridges fixedly retained on the cartridge holder track support member.

4 Claims, 12 Drawing Figures

CARTRIDGE HOLDER

This invention relates to a waist mountable cartridge holder assembly for use by police officers, military personnel and civilian users. More particularly, the cartridge holder assembly is provided with a cartridge holder track support member which snap clampably receives and supports individual cartridges in spaced-apart, elevated stationary positions above the cartridge track support platform so as to facilitate easy loading and selected unloading of each individual cartridge from the cartridge holder, as desired. The cartridge holder assembly includes a case having a foldable cover which may selectively include: (1) a cartridge speed loader and cartridge holder track support member, (2) a single cartridge holder track support member, (3) a pair of opposed cartridge holder track support members which matingly close upon each other so that the cartridges positioned thereon supportably engage each other upon closure of the case, and/or (4) a plurality of opposed pairs of opposed cartridge holder track support members which matingly close upon each other so that the cartridges positioned thereon supportably engage upon closure of the case.

In the preferred embodiment of the invention, the cartridge holder assembly comprises a cartridge holder case which is adapted to be selectively positioned on a belt worn around the waist of the user. The preferred embodiment of the cartridge holder assembly includes a standard cartridge speed loader and a cartridge holder track support member positioned proximate thereto and is provided with a downwardly opening contoured cover closure member.

It is thus seen, that the use of the unique cartridge holder track support member permits the direct easy loading or unloading of individual cartridges or rounds therefrom by the user as required to load the weapon involved. Further, the individual cartridges are thus maintained in suspended stationary fixed spaced-apart positions relative to each other and relative to the case in which the cartridge holder track support member is mounted. This positioning of the cartridges greatly facilitates the selected removal of individual cartridges from the track support member by the user.

There are many types of cartridge holder structures in the prior art. Some of the prior art cartridge holder structures comprise cartridge belts having a plurality of exposed individual cartridge holders for mounting of the individual cartridges flush against the belt without any protection against the elements. In the other prior art cartridge holder structures which comprise cartridge cases or containers, such cases or containers involve cartridge rack holders or clips which must be removed from the case before the individual round can be obtained by the user. Further, most of the cartridge pouches in present use carry a plurality of loosely loaded cartridges which are free to move against each other while in the pouch and are intended for multiple gravity unloading of the cartridges into the hand of the user. As will be described hereinafter, this type of plural delivery of multiple cartridges into the hand of the user creates problems for the user in loading his gun under adverse fighting or surveillance conditions.

It is thus seen that none of the prior art cartridge holder structures or assemblies provide a cartridge holder assembly such as the applicant's structure which includes at least one cartridge holder track support member which snap clampably receives and supports individual cartridges in a parallel spaced-apart elevated fixed position above the cartridge track support base so as to facilitate easy loading and selected unloading of each individual cartridge from the cartridge holder, as desired. Thus positioned on the cartridge holder track support member, an individual cartridge is maintained in a fixed position readily available to the user even in darkness or other adverse situations encountered in police and military situations where speed, accuracy and silence are of absolute criticality in removing the individual cartridges from the cartridge holder track support member ready for loading thereof into the weapon.

It is therefore an object of this invention to provide a unique cartridge holder track support member which snap clampably receives and supports individual cartridges in a fixed spaced-apart, elevated stationary position above the cartridge track support base so as to facilitate easy loading and selected unloading of each individual cartridge from the cartridge holder track support member.

Another object of this invention is to provide a cartridge holder track support member which snap clampably receives and supports individual cartridges in a spaced-apart elevated stationary fixed position so as to permit the user to slide one digit of his hand beneath the suspended cartridge while engaging the opposite side of the cartridge so as to easily grasp and remove the cartridge from the track support member in a quick easy movement and properly positioned in the hand of the user for immediate loading into the gun.

Another object of this invention is to provide a cartridge holder track support member which has the capability to fixedly support a plurality of spaced-apart individual cartridges in spaced-apart transversely oriented longitudinally aligned positions relative to each other so as to permit the user to selectively pick or "peel" the endmost available cartridge from either end of the track support member for loading into a gun as desired.

Another object of this invention is to provide a waist mountable cartridge holder assembly which comprises a cartridge holder case having a standard cartridge speed loader and a cartridge holder track support member positioned proximate thereto.

Yet another object of this invention is to provide a waist mountable cartridge holder assembly which comprises a cartridge holder case having a downwardly opening cover member so as to provide ready access to individual cartridges positioned in a cartridge holder track support member mounted in a vertically oriented position within the cartridge holder case.

Another object of this invention is to provide a waist mountable cartridge holder assembly which comprises a cartridge holder case having at least one cartridge holder track support member which is vertically oriented so as to facilitate selected removal of individual cartridges therefrom.

A still further object of this invention is to provide a waist mountable cartridge holder assembly which comprises a cartridge holder case provided with at least one pair of longitudinally oriented opposed spaced-apart cartridge holder track support members which are positioned within the cartridge holder case in aligned register so that upon closure of the holder case they matingly close upon each other so as to further secure individual cartridges mounted therein against undesired movement relative to each other or from inadvertent dislodgement from their repsective recesses provided on the track support member.

Yet another object of this invention is to provide a cartridge holder assembly which is particularly suited for use by civilian police personnel, military police, specialized military or government security personnel and by civilian users in such areas as target shooting and/or hunting.

A still further object of this invention is to provide a cartridge holder assembly which can be readily and easily utilized by users of pistols, rifles, shotguns or any type of gun which requires the rapid hand loading of individual cartridges or shells.

Other objects and advantages found in the construction of the invention will be apparent from a consideration of the following specification in connection with the appended claims and the accompanying drawings.

IN THE DRAWINGS

SPECIFIC DESCRIPTION

Figure 1:
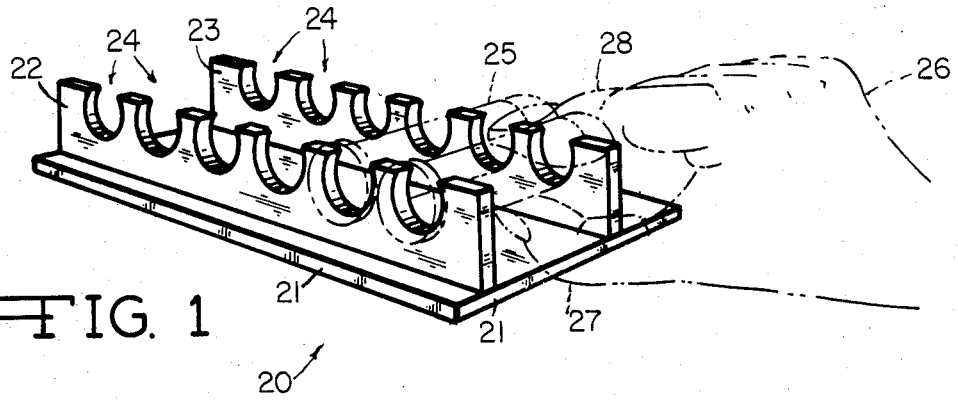
FIG. 1 is a perspective view of the cartridge holder track support member showing in phantom lines two cartridges in snap clamped fixed suspended position thereon with the finger and thumb of the user grasping a cartridge for easy removal of the track support member.
Figure 2:
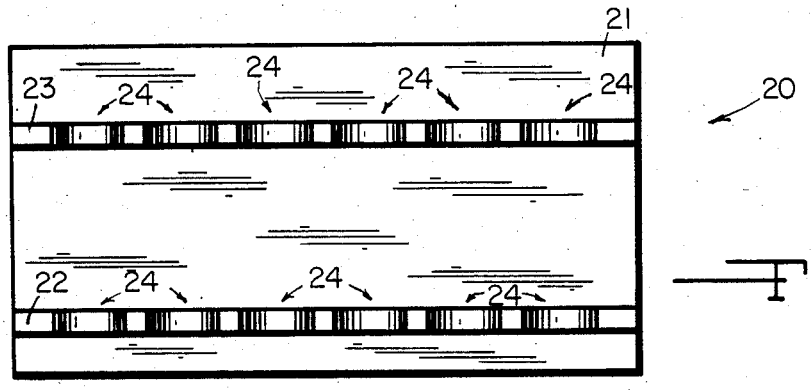
FIG. 2 is a top plan view of the cartridge holder track support member.
Figure 5:
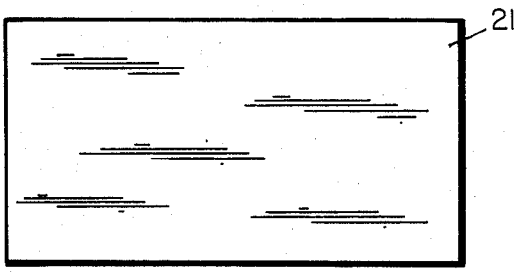
FIG. 5 is a bottom plan view of the cartridge holder track support member.
Figure 3:
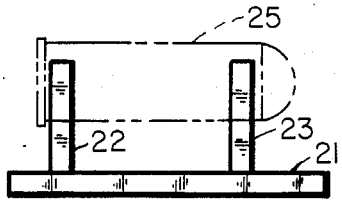
FIG. 3 is an end elevational view of the cartridge holder track support member showing in phantom line a cartridge positioned in a fixed elevated transversely oriented position above the base.
Figure 4:
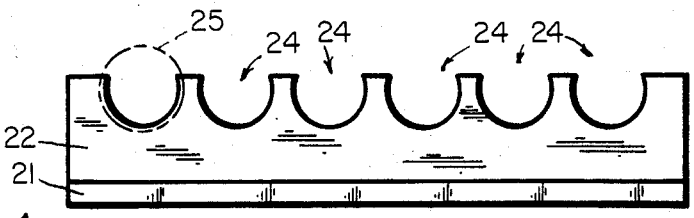
FIG. 4 is a side elevational view of the cartridge holder track support member showing in phantom line a cartridge snap clampably positioned in the corresponding recesses provided thereon.

As shown generally in the drawings and more specifically in FIGS. 1 through 5, a cartridge holder track support member 20 is provided comprising a base 21 having a pair of longitudinally oriented elongate spaced-apart cartridge support walls 22 and 23 extending upwardly therefrom. A plurality of curved support recesses 24 are provided along the upper longitudinal edges of the support walls 22 and 23. Selected pairs of the recesses 24 provided in the support walls 22 and 23 are in opposed traverse aligned register with each other so as to snap clampably supportably engage a cartridge 25 therein as shown in FIGS. 1 and 3. Thus mounted, each of the cartridges 25 are fixedly supported by the support walls 22 and 23 in a transversely oriented longitudinally aligned spaced-apart suspended position relative to each other and spaced-apart from and above the base 21.

It should be noted that the corresponding pairs of transversely aligned curved cartridge support recesses 24 are configured so as to make snap clamping engagement with the outer circumferential suface of the cartridge 25 placed therein as shown in FIGS. 1 and 3. This snap clamping engagement permits the cartridge to be fixedly retained by the track support member against inadvertent dislodgement while being carried but permits easy access and removal by the user as required.

Although the cartridge holder track support member 20 is shown with a capacity for fixedly engageably supporting six cartridges in longitudinally aligned transversely oriented positions thereon, it is considered to be within the scope of the invention to vary the configuration of the track support member to supportably engage any desired number of cartridges thereon.

In use, the cartridges 25 fixedly supported on the track support member 20 in the above-described manner are readily accessible to the hand 26 of the user as required. As shown in FIG. 1, the thumb 27 can be readily inserted below the suspended endmost cartridge 25. Finger 28 is positioned above the cartridge 25 so as to easily grasp the fixedly suspended cartridge therebetween and remove it from the track support member 20 ready for loading into the chamber of the gun.

A preferred embodiment of the cartridge holder assembly 29 is shown in FIGS. 6 through 9 in its normal use orientation when mounted at the waist of the user. The cartridge holder assembly 29 is shown in its closed position in FIG. 6 and in its open position in FIG. 7.

Figure 7:
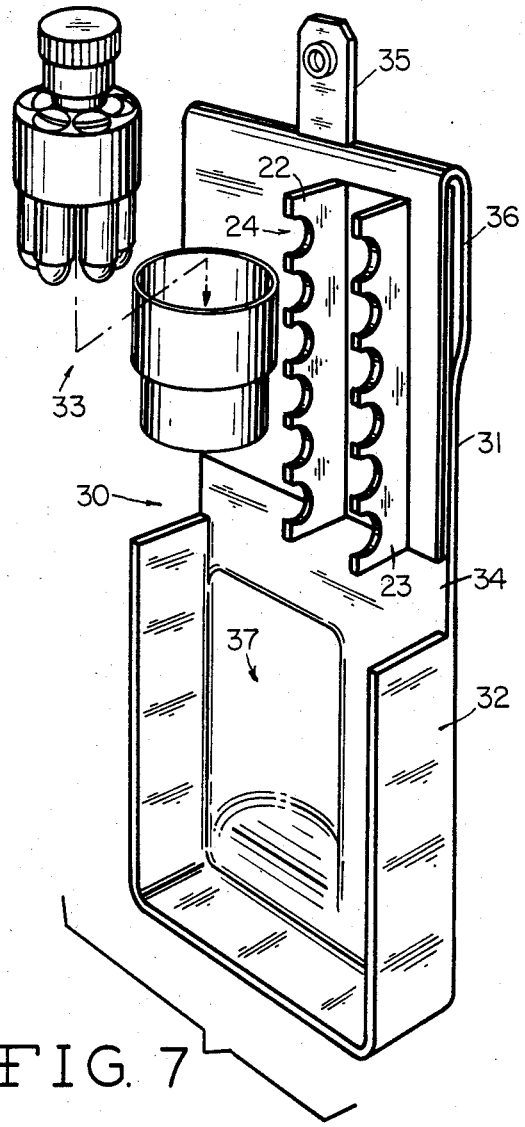
FIG. 7 is an exploded perspective view of the cartridge holder assembly in its normal use orientation with the case in its downward open position showing a standard cartridge speed loader and the cartridge holder track support member mounted thereon.
Figure 8:
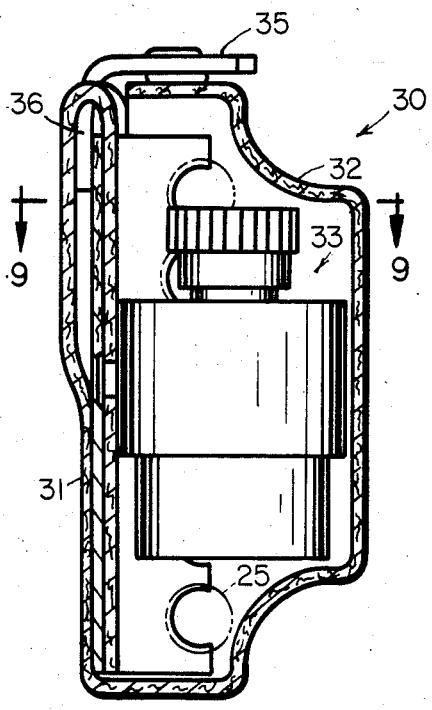
FIG. 8 is a sectional view of the cartridge holder taken on line 8—8 of FIG. 6.
Figure 9:
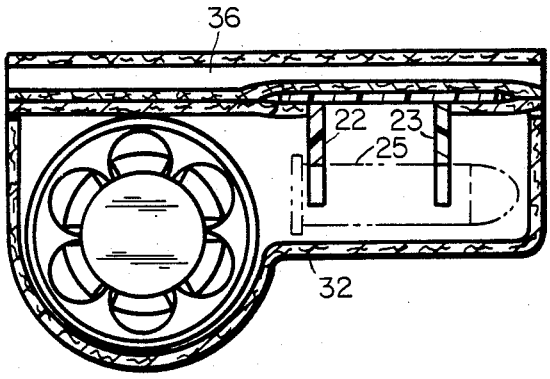
FIG. 9 is a sectional view of the cartridge holder taken on line 9—9 of FIG. 8.

As shown specifically in FIG. 7, the cartridge holder assembly 29 is comprised of a case holder 30 having a base member 31 and a downwardly opening cover member 32.

A standard cartridge speed loader assembly 33 is mounted on the base 31 proximate to the cartridge holder track support member 20. The standard cartridge speed loader assembly 33 per se is well known in the art and will not be discussed herein in detail. Suffice it to say that the speed loader 33 enables the user to simultaneously load six rounds into his pistol and its presence in the cartridge holder assembly adds to the overall utility provided by the cartridge holder assembly 29 as described herein.

Figure 6:
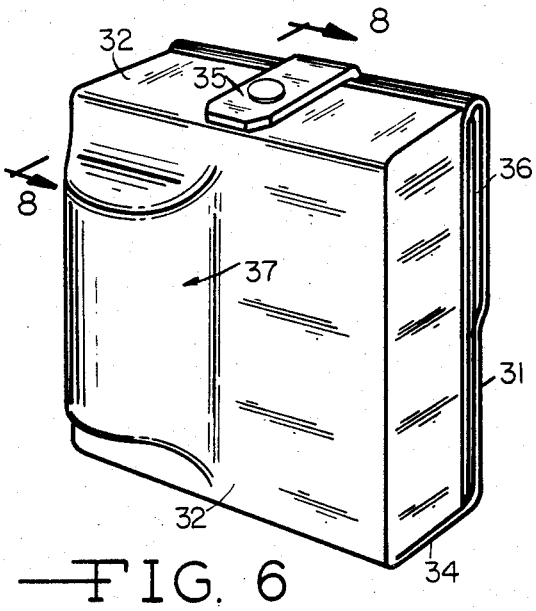
FIG. 6 is a perspective view of the waist mountable cartridge holder assembly showing the case in its closed position and in its normal use orientation on the waist of a user.

A foldable unitary hinge portion 34 permits the outward and downward unfolding of the cover member 32 when the snap lock tab 35 extending from the base portion 31 is unfastened from its cover retaining locked position shown in FIG. 6.

The base member 31 is provided with a belt receiving loop portion 36 adapted to receive a waist belt (not shown) which is utilized to retain the cartridge holder assembly 29 at the waist of the user in its normal use orientation as shown in FIG. 6. It is also within the scope of the invention that a clip (not shown) is provided on the back of the base member in place of the belt loop. This enables the user to attach the cartridge holder assembly to his belt as required and to easily remove it thereon when not in use.

The case holder 30 is generally fabricated from heavy leather wherein the base 31, the hinge portion 34 and the cover portion 32 are integrally formed. As shown generally in FIGS. 6–9, the cover member 32 is contoured so as to fit closely over the speed loader 33 and the track support holder 20 positioned on the base when the cover is in its closed position. A well portion 37 is defined in the cover 32 so as to accommodate the speed loader 33. Although leather is predominantly used to fabricate the case, it is considered to be within the scope of the invention to fabricate portions or all of the case from plastic or other suitable materials.

The waist mountable cartridge holder assembly 29 finds great utility and versatility in use by providing the user easy and quick access to individual cartridges fixedly mounted on the cartridge holder track support member 20 provided therein as previously described. Additional utility is provided by the overall configuration and orientation of the case member 29. When in the closed position, the cartridge holder assembly 29 provides an easily accessible container for storage of individual cartridges in a fixed spaced-apart relationship which eliminates any noise from cartridges moving against each other when the user is moving. This "silent" capability in movement is critical under surveillance conditions. When the need for reloading arises, the user unsnaps the tab 35 and the cover 32 easily flips to its open position as shown in FIG. 7. Thus, without even looking, the user has immediate one hand access to either the speed loader 33 or the individual cartridges 25 clampably supported on the cartridge track support member 20. There is no need to remove or otherwise handle ancillary clip members which hold multiple cartridges. The use of the cartridge holder track support member 20 is of particular importance in combat or surveillance situations in which the user must stealthily and quietly reach for and easily grasp the individual cartridge in such a manner that the grasping of the individual cartridge is a one-step movement in which it is immediately positioned in the hand of the user for quick and quiet reloading of his weapon. The user is thus provided with a unique cartridge holder track support member with the capability of having ready access to a fixedly mounted individual cartridge which is readily and easily available to him regardless of adverse conditions, i.e. in darkness, prone or cramped positions and the like.

In contrast, ammunition pouches in common use today are predicated on the principle of gravity unloading of the individual loose cartridges which are freely loaded and are not secured against relative movement within the pouch. This type of gravity unloading generally presupposes that the user is in a standing position or at least that the ammunition pouch is in a vertically oriented position in order to effectively unload the cartridges. In a fire-fight where the police officer or soldier is in a prone position, such a limitation presents great difficulty when the user attempts to obtain a cartridge from the standard pouch. The use of the track support member 20 enables the user to obtain a cartridge regardless of the unusual position (prone, inclined or otherwise) that he finds himself in due to the exigencies of combat.

Further, in ammunition pouches in use today, the individual rounds are freely loaded therein and hence multiple cartridges are indiscriminately delivered to the hand of the user. This creates a problem to the user when only a single cartridge or specific number of cartridges are desired. The use of the track support member avoids this problem inasmuch as each individual cartridge is fixedly held as described herein. This enables the user to easily select a single cartridge or any desired number of cartridges that he wishes to selectively "peel" from the track support member, regardless of the body position, prone or otherwise, that the user is forced into by the combat or surveillance situation.

Another disadvantage of the ammunition pouches in use today is that if the cartridges are loaded pointing in the same direction, they tend to jam within the pouch so as to make unloading difficult. In fact, some of the prior known pouches have flaps at each end so that the user can selectively push cartridges from the pouch when they have jammed so as to resist gravity unloading.

The use of the cartridge track support member enables the user to load his cartridges facing in the same direction. Heretofore in standard ammunition pouches which freely receive and hold the cartridges in an unrestrained manner, the user has had to load the cartridges pointed alternate directions so as to minimize the jamming possibilities within the pouch during the unloading process. This presents an additional problem to the user because he must undergo a second time-consuming step to properly orient the cartridges for subsequent loading into his weapon. This delay, however minute, could prove disastrous in a fire-fight.

Figure 10:
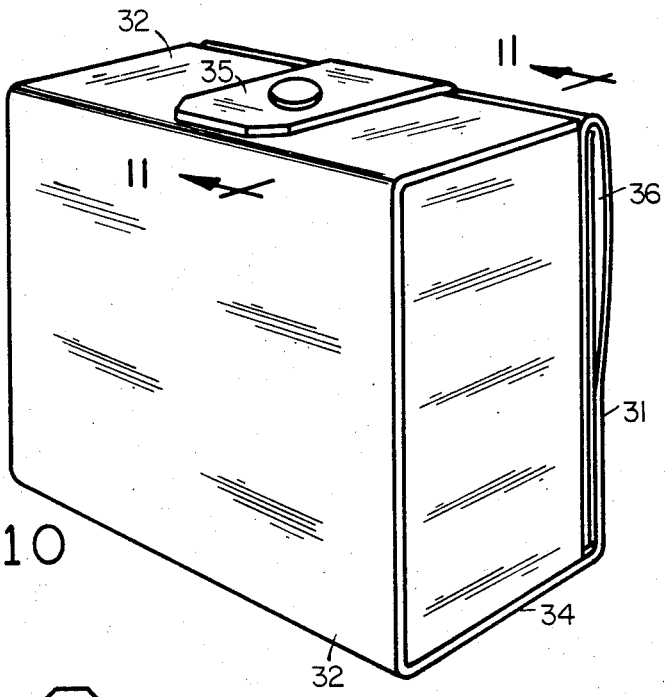
FIG. 10 is a perspective view of another embodiment of the waist mountable cartridge holder assembly in its closed normal use orientation.
Figure 12:
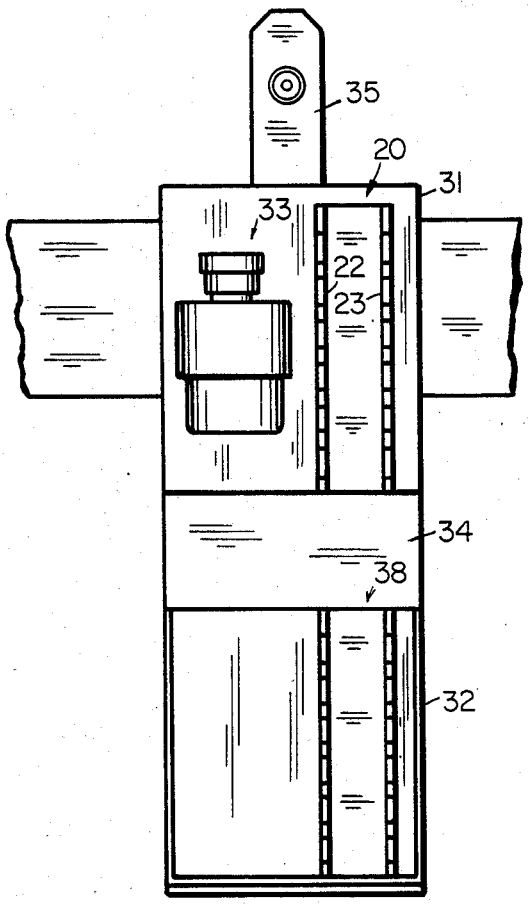
FIG. 12 is a front elevational view of the cartridge holder assembly in its open position showing a pair of spaced-apart opposed cartridge holder track support members in longitudinally oriented register with each other.
Figure 11:
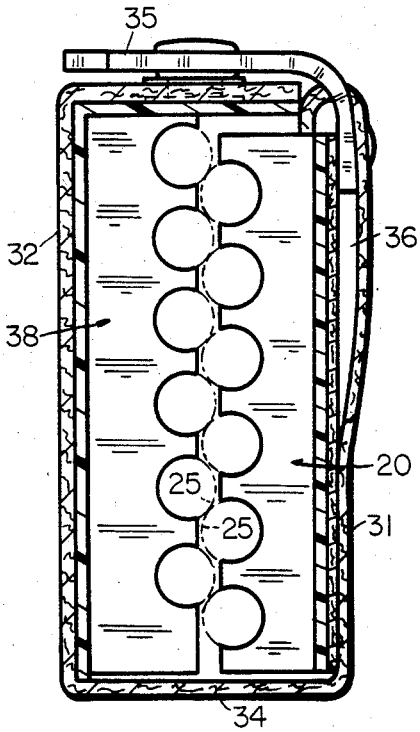
FIG. 11 is a sectional view of the cartridge holder assembly taken on the line 11—11 of FIG. 10 and showing the cartridge holder track support members in mating engagement whereby the opposed cartridges mounted thereon selectively bear against each other to secure them within their respective recessed positions in their respective track support members.

Another embodiment of the cartridge holder assembly 29 is shown in FIGS. 10–12. A modified cover portion 37 is provided which is not contoured and is configured to accommodate another cartridge track support member 38 which is in opposed aligned register with the track support member 20 provided on the base 31. The track support member 38 is positioned so as to be slightly offset longitudinally in relation to the track support member 20 when the cartridge holder assembly is in its closed position as shown in FIG. 11. Thus positioned, the track support member 38 is in aligned mating register with the track support member 20 in such a manner that the cartridges (shown in phantom line) which are transversely suspended in each track support member 38 and 20 respectively, bear against each other. In this manner, it is insured that the individual cartridges are retained in their respective recesses 24 against inadvertent dislodgement. It should be noted that the cartridges in the track support member 38 must be pointed in the opposite transverse direction than the cartridges positioned on the corresponding track support member 20 for the mating nestled interrelationship shown in FIG. 11 and described herein.

It is within the scope of the invention to eliminate the speed loader 33 and replace it with an additional pair of opposed track support members in its place, thus doubling the carrying capacity of individual cartridges. It is also within the scope of the invention to provide a narrow container with only a pair of opposed track support members or even just one track support member provided in a small but identically operating case member.

Additional advantages of this unique case which fully covers the individual fixedly mounted cartridges, are that (1) they are protected from the elements, (2) they are protected from damage from inadvertent collision with each other within the case, and (3) disturbance of public sensitivity to an open display of ammunition is avoided.

In summary, a cartridge holder track support member is provided for use in holding individual cartridges in fixed parallel spaced-apart elevated positions within a cartridge case. The cartridge case comprises a support base having a pair of longitudinally oriented elongate spaced-apart cartridge support walls extending upwardly therefrom. The support walls are provided with a plurality of corresponding curved cartridge engaging recesses along the upper longitudinal edges thereof. Selected pairs of the curved cartridge engaging recesses are in aligned register so as to selectively snap clampably supportably engage an individual cartridge in a transversely oriented elevated spaced-apart position above the base upon the spaced-apart cartridge support walls. Each of the recesses is curvably configured so as to make snap clampable engagement with the outer circumference of an individual cartridge positioned therein. The spaced-apart recesses provided on one of the support walls are in corresponding aligned register with the recesses provided on the other of the spaced-apart support walls. The recesses are adapted to snap clampably supportably engage a plurality of individual cartridges upon the spaced-apart support walls in transversely oriented spaced-apart longitudinally aligned positions above the base.

A cartridge holder assembly is provided for storing and positioning individual cartridges in fixed positions therein for ready access to a user. The cartridge holder assembly comprises a cartridge case having integrally formed base, foldable hinge and cover portions. The cover portion is selectively foldable so as to protectably cover the base portion. Snap tab lock means are provided to extend from the base portion so as to lockably engage the cover portion when the cover portion is in its closed covering position on the base portion. The snap tab lock means are selectively snap releasable so as to allow the cover portion to be selectively flipped to its open position. A cartridge speed loader assembly is fixedly positioned upon the base portion. A first cartridge holder track support member is also fixedly positioned on the base portion so as to snap clampably supportably engage a plurality of individual cartridges in transversely oriented spaced-apart longitudinally aligned positions above the base portion. The cover portion adapted to fully cover the speed loader assembly and the first track support member when the cover portion is in its closed position upon the base portion.

In this embodiment of the invention the cover portion is selectively contoured so as to be in close covering relationship to the speed loader and the first track support member when the cover is in its closed position.

Another embodiment of the cartridge holder assembly is provided for storing and positioning individual cartridges in fixed positions therein for ready access to a user. This cartridge holder assembly comprises a cartridge case having integrally formed base, foldable hinge and cover portions. The cover portion is selectively foldable so as to protectably cover the base portion. Snap tab lock means are provided to extend from the base portion so as to lockably engage the cover portion when the cover portion is in its closed covering position on the base portion. The snap tab lock means are selectively snap releasable so as to allow the cover portion to be selectively flipped to its open position. A first cartridge track support member is fixedly positioned on the base portion so as to snap clampably supportably engage a plurality of individual cartridges in transversely oriented spaced-apart longitudinally aligned positions above the base portion. The cover portion is adapted to fully cover the first track support member when the cover portion is in its closed position upon the base portion.

Yet another embodiment of the invention includes herein the addition of a second cartridge track support member which is positioned on the cover portion in opposed longitudinally aligned register with the first cartridge track support member. The second cartridge track support member is adapted to matingly register with the first cartridge track support member when the cover is in its closed position on the base portion. The first cartridge track support member and the second cartridge track support member are adapted to move into mating register upon closure of the cover member so that individual cartridges fixedly positioned thereon are moved into retentive contact with each other when the cover portion is in its closed position. It is within the scope of the invention to provide another embodiment of the cartridge holder assembly wherein at least one pair of additional opposed longitundinally aligned cartridge track support members are provided in corresponding parallel spaced-apart relationship with the first cartridge track support and the second cartridge track support member so as to increase the carrying capacity of the cartridge holder assembly.

It is thus seen that a highly utilitarian waist mountable cartridge holder assembly is provided with a unique quick opening flip-type cover which can be selectively opened to expose a readily accessible standard speed loader assembly and/or a unique cartridge holder track support member which is configured to snap clampably receive and support a plurality of individual cartridges in a spaced-apart elevated fixed position above the cartridge track support base so as to facilitate easy loading and selected unloading of each fixedly mounted cartridge from the cartridge holder, as needed by the user. The invention is further characterized by the fact that the individual cartridges are fixedly held in an elevated easy-to-grasp position so that the user can pick off each individual cartridge from the track support holder so that it is at once positioned in the grasp of his fingers properly oriented for easy insertion into the chamber of his gun.

Various other modifications of the invention may be made without departing from the principle thereof. Each of the modifications is to be considered as included in the hereinafter appended claims unless these claims by their language expressly provide otherewise.

I claim:

1. In a cartridge holder assembly for storing and positioning individual cartridges in vertically stacked horizontally oriented spaced-apart fixed positions therein for ready access to a user comprising:

a cartridge case, said cartridge case having integrally formed base, foldable hinge and cover portions, said cover portion selectively foldable so as to protectably cover said base portion;

snap tab lock means extending from said base portion so as to lockably engage the upper end of said cover portion when said cover portion is in its closed covering position on said base portion, said snap tab lock means being selectively snap releasable so as to allow said cover portion to be selectively flipped to its downwardly extending open position;

a cartridge speed loader assembly fixedly positioned upon said base portion;

a first cartridge holder track support member fixedly positioned on said base portion, said track support member provided with spaced-apart cartridge receiving recesses so as to snap clampably supportably engage a plurality of individual cartridges in vertically stacked horizontally oriented spaced-apart positions fixedly suspended apart from said base portion, said recesses being spaced apart from said base portion so as to enable finger access between said base and said cartridges placed in said receivers; and a second cartridge track support member positioned on said cover portion in opposed longitudinally aligned register with said first cartridge track support member, said second cartridge track support member adapted to matingly register with said first cartridge track support member when said cover is in its closed position on said base portion, said first cartridge track support member and said second cartridge support member adapted to move into mating register upon closure of said cover member so that individual cartridges fixedly positioned thereon are moved into retentive contact with each other when the cover portion is in its closed position, said cover portion adapted to fully cover said speed loader assembly, said first cartridge holder track support member and said second cartridge holder track support member when said cover portion is in its closed position upon said base portion.

2. In a cartridge holder assembly for storing and positioning individual cartridges in vertically stacked horizontally oriented spaced-apart fixed positions therein for ready access to a user comprising:

a cartridge case, said cartridge case having integrally formed base, foldable hinge and cover portions, said cover portion selectively foldable so as to protectably cover said base portion;

snap tab lock means extending from said base portion so as to lockably engage the upper end of said cover means when said cover portion is in its closed covering position on said base portion, said snap tab lock means being selectively snap releasable so as to allow said cover means to be selectively flipped to its downwardly extending open position;

a first cartridge holder track support member fixedly positioned on said base portion, said track support member provided with spaced-apart cartridge receiving recesses so as to snap clampably supportably engage a plurality of individual cartridges in vertically stacked horizontally oriented spaced-apart positions fixedly suspended apart from said base portion, said recesses being spaced apart from said base portion so as to enable finger access between said base and said cartridges placed in said recesses; and a second cartridge holder track support member positioned on said cover portion in opposed longitudinally aligned register with said first cartridge track support member, said second cartridge track support member adapted to matingly register with said first cartridge track support member when said cover is in its closed position on said base portion, said first cartridge track support member and said second cartridge support member adapted to move into mating register upon closure of said cover member so that individual cartridges fixedly positioned thereon are moved into retentive contact with each other when the cover portion is in its closed position, said cover portion adapted to fully cover said first cartridge holder track support member and said second cartridge holder track support member when said cover portion is in its closed position upon said base portion.

3. In a cartridge holder assembly for storing and positioning individual cartridges in vertically stacked horizontally oriented spaced-apart fixed positions therein for ready access to a user comprising:

a cartridge case, said cartridge case having integrally formed base, foldable hinge and cover portions, said cover portion selectively foldable so as to protectably cover said base portion;

snap tab lock means extending from said base portion so as to lockably engage the upper end of said cover portion when said cover portion is in its closed covering position on said base portion, said snap tab lock means being selectively snap releasable so as to allow said cover portion to be selectively flipped to its downwardly extending open position;

a cartridge speed loader assembly fixedly positioned upon said base portion;

a first cartridge holder track support member fixedly positioned on said base portion, said track support member provided with spaced-apart cartridge receiving recesses so as to snap clampably supportably engage a plurality of individual cartridges in vertically stacked horizontally oriented spaced-apart positions fixedly suspended apart from said base portion, said recesses being spaced apart from said base portion so as to enable finger access between said base and said cartridges placed in said recesses;

a second cartridge holder track support member positioned on said cover portion in opposed longitudinally aligned register with said first cartridge track support member, said second cartridge track support member adapted to matingly register with said first cartrigde track support member when said cover is in its closed position on said base portion, said first cartridge track support member and said second cartridge support member adapted to move into mating register upon closure of said cover member so that individual cartridges fixedly positioned thereon are moved into retentive contact with each other when the cover portion is in its closed position; and at least one pair of additional opposed longitudinally aligned cartridge track support members provided in corresponding parallel spaced-apart relationship with said first cartridge holder track support and said second cartridge holder track support member, said cover portion adapted to fully cover said speed loader assembly, said first cartridge holder track support member, said second cartridge holder track support member, and said pair of additional opposed longitudinally aligned cartridge track support members when said cover portion is in its closed position upon said base portion.

4. In a cartridge holder assembly for storing and positioning individual cartridges in vertically stacked horizontally oriented spaced-apart fixed positions therein for ready access to a user comprising:

a cartridge case, said cartridge case having integrally formed base, foldable hinge and cover portions, said cover portion selectively foldable so as to protectably cover said base portion;

snap tab lock means extending from said base portion so as to lockably engage the upper end of said cover means when said cover portion is in its closed covering position on said base portion, said snap tab lock means being selectively snap releasable so as to allow said cover means to be selectively flipped to its downwardly extending open position;

a first cartridge holder track support member fixedly positioned on said base portion, said track support member provided with spaced-apart cartridge receiving recesses so as to snap clampably supportably engage a plurality of individual cartridges in vertically stacked horizontally oriented spaced-apart positions fixedly suspended apart from said base portion, said recesses being spaced apart from said base so as to enable finger access between said base and said cartridges placed in said recesses;

a second cartridge holder track support member positioned on said cover portion in opposed longitudinally aligned register with said first cartridge track support member, said second cartridge track support member adapted to matingly register with said first cartridge track support member when said cover is in its closed position on said base portion, said first cartridge track support member and said second cartridge support member adapted to move into mating register upon closure of said cover member so that individual cartridges fixedly positioned thereon are moved into retentive contact with each other when the cover portion is in its closed position; and at least one pair of additional opposed longitudinally aligned cartridge track support members provided in corresponding parallel spaced-apart relationship with said first cartridge holder track support member and said second cartridge holder track support member, said cover portion adapted to fully cover said first cartridge holder track support member, said second cartridge holder track support member, and said pair of additional opposed longitudinally aligned cartridge track support members when said cover portion is in its closed position upon said base portion.

* * * * *